US009663253B2

(12) United States Patent
Federici et al.

(10) Patent No.: US 9,663,253 B2
(45) Date of Patent: May 30, 2017

(54) PROCESS FOR PACKAGING A PRODUCT IN A SEALED WRAPPER OF SHEET MATERIAL

(75) Inventors: Fabio Federici, Alba (IT); Luciano Massa, Bra (IT); Giovanni Sobrero, Cerretto Langhe (IT)

(73) Assignee: Soremartec S.A., Arlon (BE)

( * ) Notice: Subject to any disclaimer, the term of this patent is extended or adjusted under 35 U.S.C. 154(b) by 805 days.

(21) Appl. No.: 13/979,726

(22) PCT Filed: Jan. 20, 2012

(86) PCT No.: PCT/IB2012/050275

§ 371 (c)(1),
(2), (4) Date: Jul. 15, 2013

(87) PCT Pub. No.: WO2012/098524

PCT Pub. Date: Jul. 26, 2012

(65) Prior Publication Data

US 2013/0291491 A1 Nov. 7, 2013

(30) Foreign Application Priority Data

Jan. 21, 2011 (IT) ..... TO2011A0043

(51) Int. Cl.
*B65B 11/02* (2006.01)
*B65B 11/50* (2006.01)
(Continued)

(52) U.S. Cl.
CPC ..... *B65B 11/02* (2013.01); *B65B 11/50* (2013.01); *B65B 25/005* (2013.01); *B65B 47/04* (2013.01)

(58) Field of Classification Search
CPC ..... B65B 5/062; B65B 11/54; B65B 25/005
(Continued)

(56) References Cited

U.S. PATENT DOCUMENTS 2,218,293 A * 10/1940 Muller ..... B65B 11/54 53/221
2,864,213 A * 12/1958 Carter ..... B65B 1/04 53/459

(Continued)

FOREIGN PATENT DOCUMENTS

EP 0199995 A1 12/1986
EP 0591742 A1 4/1994

(Continued)

*Primary Examiner* — Thanh Truong
*Assistant Examiner* — Patrick Fry
(74) *Attorney, Agent, or Firm* — Rothwell, Figg, Ernst & Manbeck, P.C.

(57) ABSTRACT

Process and corresponding apparatus for wrapping a product in a wrapper of sheet material, adhering to the surface of the product, the process comprising the steps of:

Figure 1:
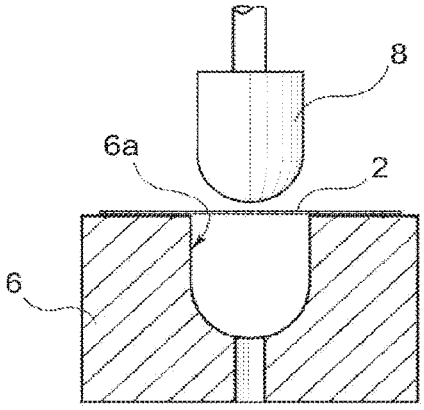

providing a first and a second sheet of wrapping material, shaping said first sheet according to a cup-shaped configuration comprising a bottom portion substantially complementary to a bottom portion of the surface of the product, a tubular portion which extends above the top of the product when inserted in said so-shaped sheet and defining a mouth adapted for the introduction of the product and an annular flange terminal portion surrounding said mouth, introducing the product in said first shaped sheet, and connecting said second sheet to said annular flange so as to form a closed wrapper around said product.

Following the introduction of the product and prior to connection of said second sheet with said annular flange, it includes the operation to make a bottleneck of said tubular portion of said first sheet in its region immediately above the top of the product, exerting on said annular flange a pressure suitable to bind the edges of flange or to limit its radial movement, so as to cause the adhesion of said tubular wall to a substantial portion of the top surface of the product.

14 Claims, 5 Drawing Sheets

(51) Int. Cl.
*B65B 25/00* (2006.01)
*B65B 47/04* (2006.01)

(58) Field of Classification Search
USPC ..... 53/221, 461, 464, 559
See application file for complete search history.

(56) References Cited

U.S. PATENT DOCUMENTS 3,133,392 A 5/1964 West
3,245,198 A * 4/1966 Schmied ..... B65B 11/54 426/412
3,851,440 A * 12/1974 Horsky ..... B65B 51/00 53/227
3,966,045 A 6/1976 Perdue
5,443,546 A * 8/1995 Bertalero ..... B29C 65/7441 53/221
5,656,233 A * 8/1997 Weder ..... A41G 1/02 264/145
5,802,806 A * 9/1998 Scaliti ..... B65B 11/54 53/221
6,513,306 B1 * 2/2003 Milano ..... B65B 11/50 53/221
7,240,466 B2 * 7/2007 Vermee ..... A22C 11/105 29/243.56
8,065,862 B2 * 11/2011 Mansuino ..... B65B 11/50 53/221
8,733,621 B2 * 5/2014 Anghileri ..... B65B 43/08 229/87.03
2004/0226267 A1 * 11/2004 Mansuino ..... B65B 9/067 53/450

FOREIGN PATENT DOCUMENTS

EP 0146579 A1 10/2000
GB 2426498 A 11/2006
WO 2008018008 A1 2/2008

* cited by examiner

PROCESS FOR PACKAGING A PRODUCT IN A SEALED WRAPPER OF SHEET MATERIAL

CROSS-REFERENCE TO RELATED APPLICATION(S)

This application is a 35 U.S.C. §371 National Phase Entry Application from PCT/IB2012/050275, filed Jan. 20, 2012, designating the United States, which also claims priority to Italian Application No.: TO2011A000043 filed Jan. 21, 2011, the disclosures of which are incorporated by reference herein in their entirety.

The present invention relates to a process for wrapping a product, in particular a confectionery product such as a praline or a chocolate, having a generally convex form in a wrapper of sheet material which can be sealed, tightly adhering to the surface of the product.

A process of the type to which the invention relates is described, for example, in EP 0 591 742 A1. In this case, the wrapper is obtained proceeding from two sheets, the first of which is shaped like a dish so as to wrap most of the product; the other sheet is then laid on the rest of the product so as to assume a form complementary to that of the product itself.

After the two sheets have been welded peripherally to give the wrapper sealing characteristics and the edges which project beyond the welding zone have been cut, the thus formed wrapper is subjected to a shaping step which causes the first sheet to cover practically the entire product, hiding the second sheet from view.

EP 1 046 579 A1 describes a process of the type indicated above, with the aim of obtaining a shaped wrapper which comprises, as an integral part of the wrapper itself, a formation like a small cup ("fluted case"). In this case, following the achievement of an intermediate packaging formed by a first bowl-shaped sheet, with a containing wall including the product and a mouth surrounded by a radial flange, and by a second sheet arranged so as to overlap and possibly be connected sealingly to said radial flange, provision is made to shape the peripheral regions of said flange to obtain a wall which surrounds the containing wall of the first shaped sheet at a radial distance, forming a small cup ("fluted case").

This step is carried out by shaping means which comprise a forming cavity, which can receive in its interior the intermediate packaging, and a male element which can penetrate into the forming cavity like a punch, so as to compress the peripheral regions of the first and of the second sheet between the inner surface of the forming cavity and the outer surface of the male element.

In order to improve the adhesion of the wrapper to the surface of the product, WO2008/018008 A1 describes a process of the type in EP 1 046 579, in which the shaping of the small cup, integral with the packaging, is obtained by means of a mandrel with radially movable petals which are able to assume a radially retracted configuration in which the petals of the mandrel are able to penetrate into a forming cavity to improve the adhesion of the wrapper to the product and simultaneously shape a portion of the wrapper into the configuration like a small cup.

It is an object of the present invention to provide a process which further makes it possible to improve the adhesion of the wrapper to the outer surface of the product, thereby limiting the presence of air within the wrapper, which is made airtight by the adhesive or welding connection between the two sheets which constitute the wrapper itself.

It is a particular object of the invention to provide a process which makes it possible to achieve the contact of the wrapper virtually over the entire surface of the product, even when the product has an outer surface with small bumps and protrusions which act as spacers between the outer general surface of the product and the wrapper.

These bumps and/or protrusions are typical, for example, in a praline having a generally convex form, to the surface of which pieces of chocolate or of dried fruit or coconut shavings, for example, are applied.

In view of these objects, the invention relates to a process and an apparatus having the features defined in the claims which follow and which form an integral part of the present description.

Figure 2:
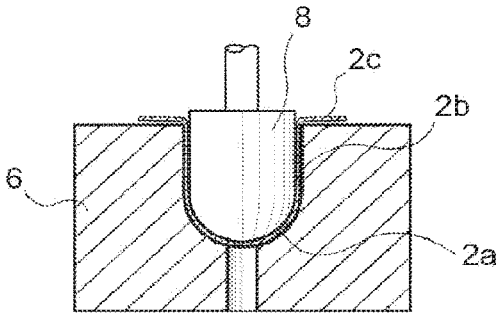
Figure 5:
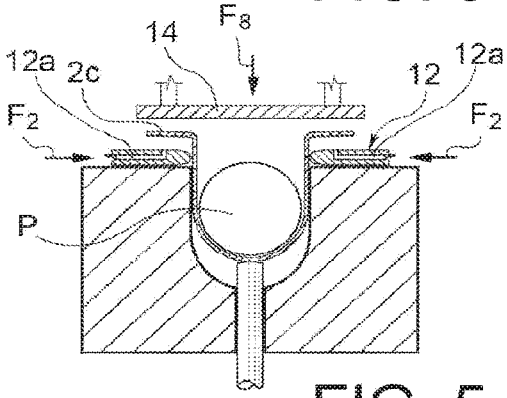
Figure 6:
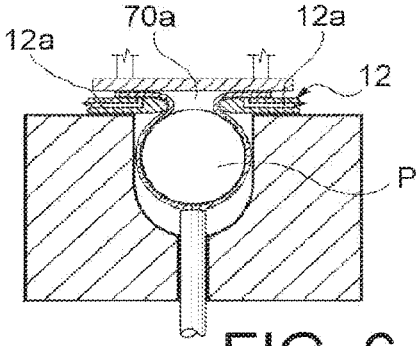
Figure 1A:
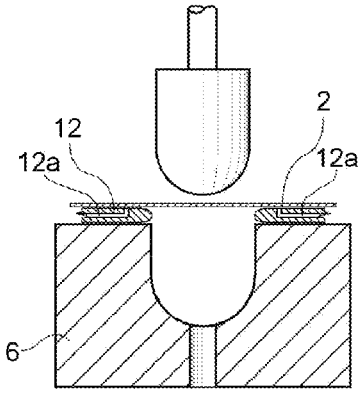
Figure 2A:
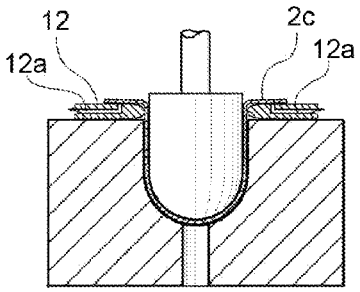
Figure 6A:
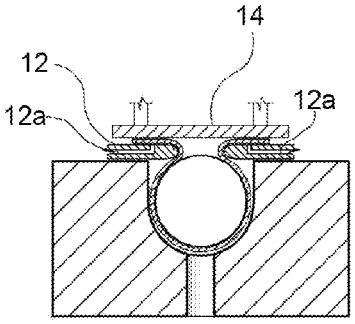
Figure 12:
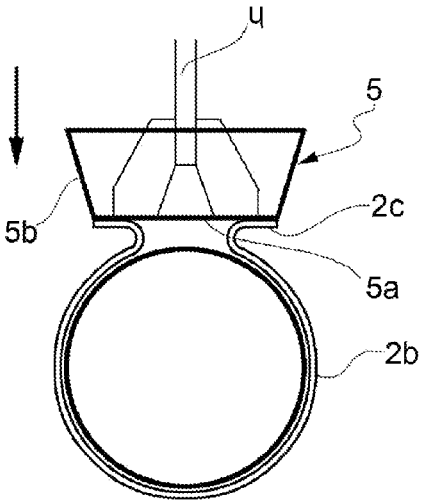
Figure 13:
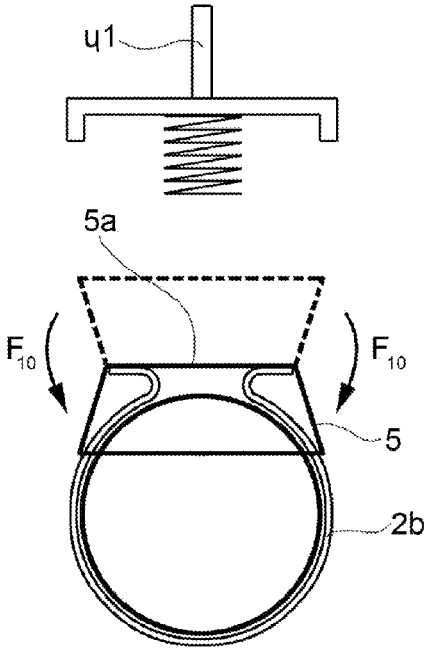
Figure 8:
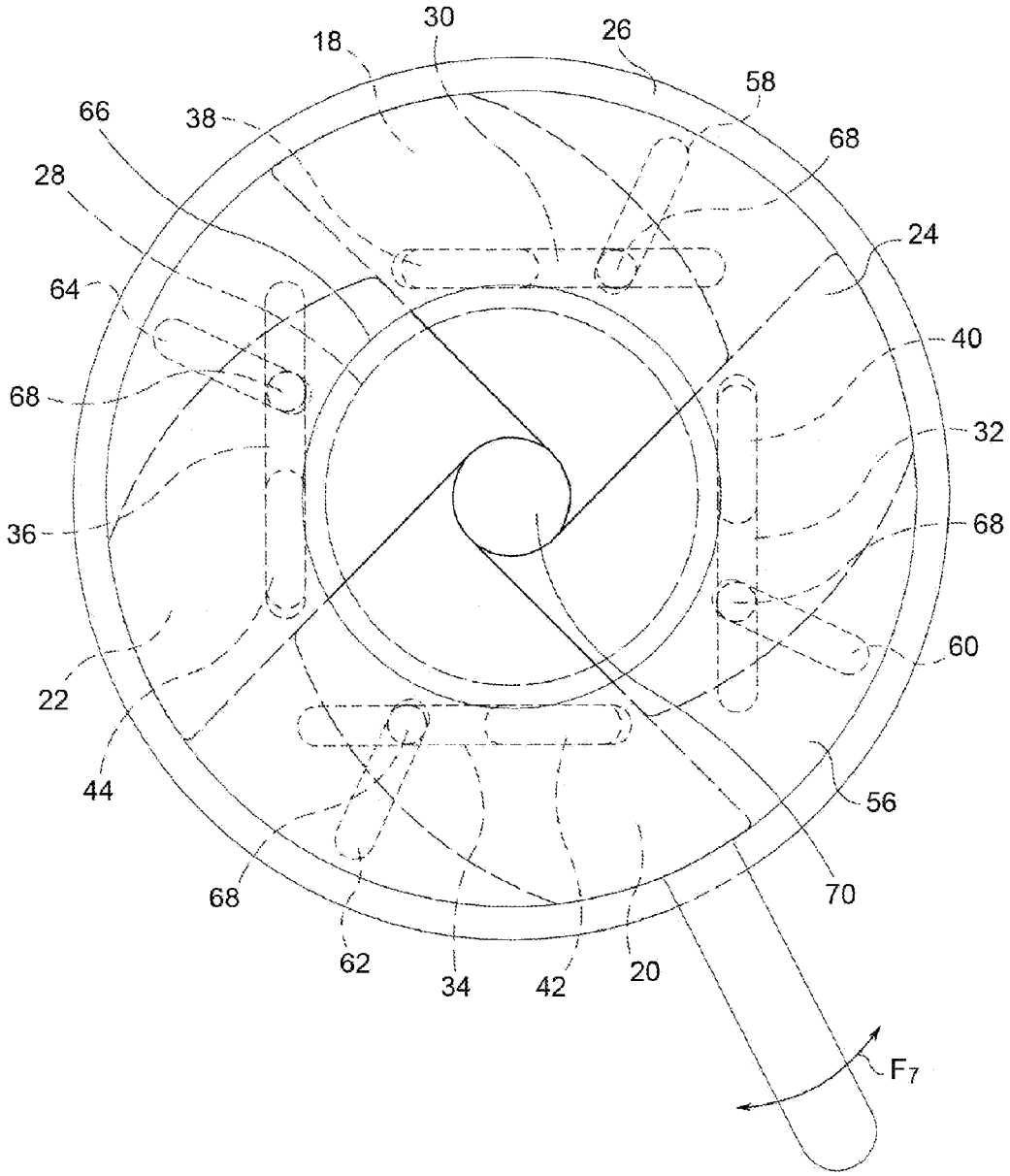
Figure 9:
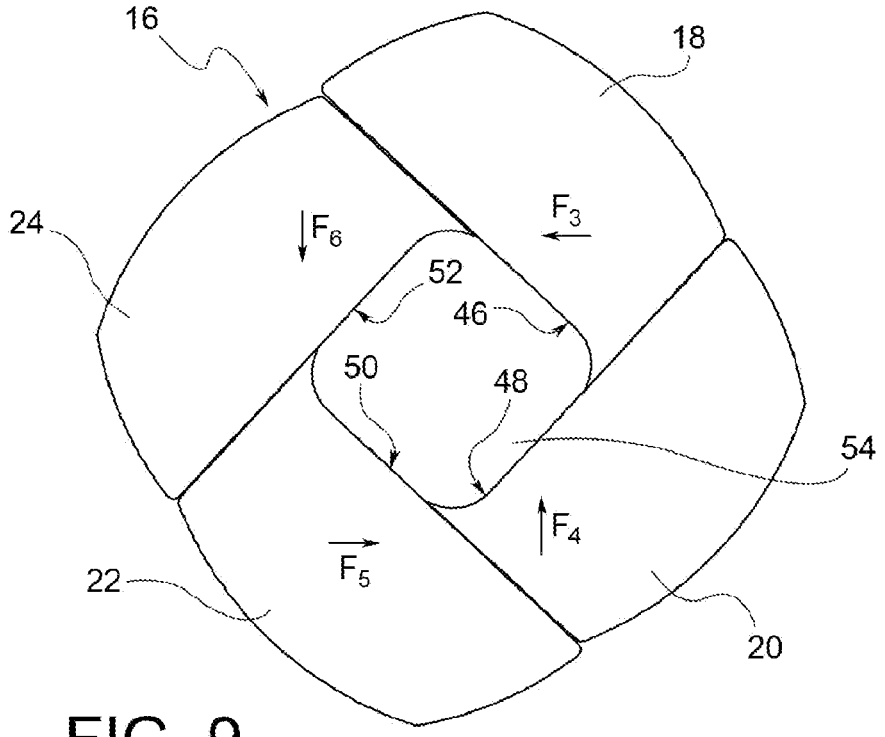
Figure 10:
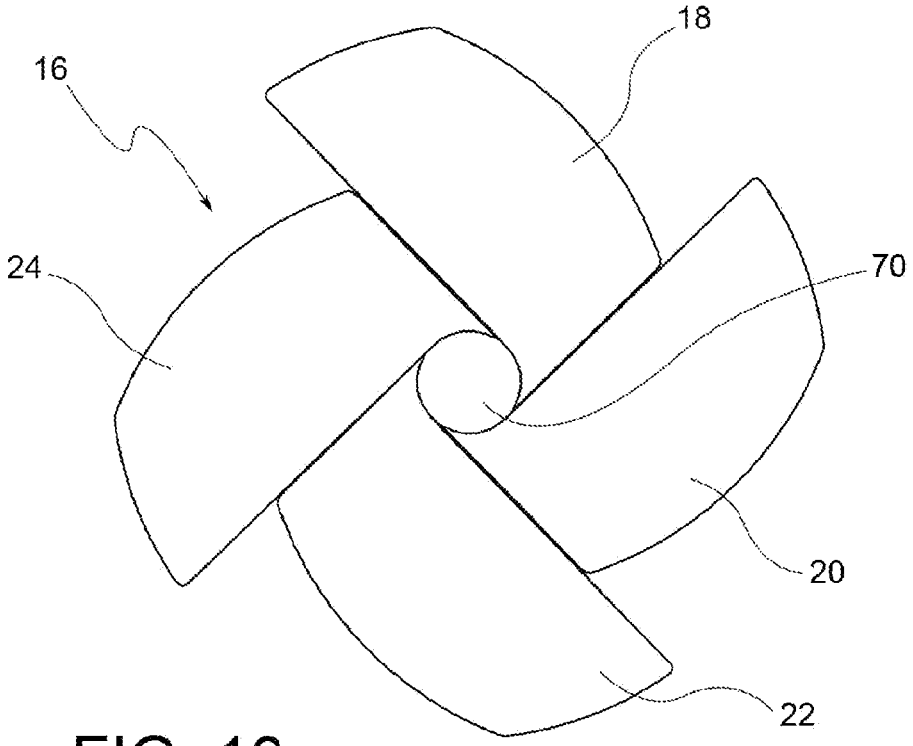
Figure 11:
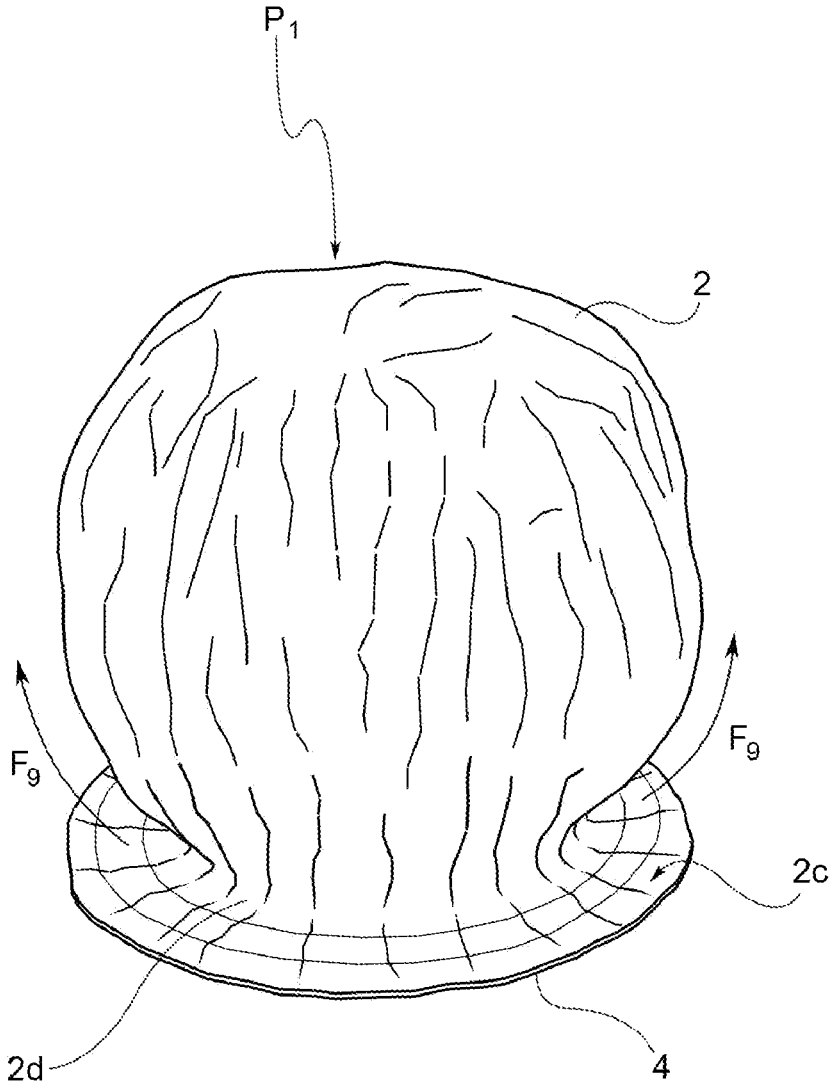

The invention will now be described, purely by way of non-limiting example, with reference to the accompanying drawings, in which:

FIGS. 1 to 7 show successive steps of an embodiment of the process according to the invention;

FIGS. 1*a*, 2*a* and 6*a* are realisation steps corresponding to those in FIGS. 1, 2 and 6 in an alternative embodiment of the process;

FIG. 8 is a plan view of an iris tool used in the process;

FIGS. 9 and 10 are schematic plan views showing two configurations of the shutter means of the iris tool shown in FIG. 8 and respectively shown in FIGS. 5 and 6 with the detail 12;

FIG. 11 is a perspective view showing the final result of the packaging operation comprising the steps shown in FIGS. 1 to 7; and FIGS. 12 and 13 are schematic views showing operational steps which follow the step shown in FIG. 6 or 6*a*, in an embodiment of the process which leads to a product packaged in a sealed wrapper comprising a small cup or fluted case associated therewith.

The product which is to be packaged is constituted, in the exemplary embodiment shown, by a praline P with a spherical overall shape. In particular, this may be a praline which is constituted by a spherical wafer shell with a pasty and creamy filling, coated on the outside with chocolate or a similar coating, possibly with the application of granular food substances, such as coconut shavings, hazelnut pieces and the like, which give the outer surface of the praline an irregular overall aspect.

The process according to the invention is particularly advantageous for obtaining adhesion of the wrapper to an irregular surface of the type indicated above; however, the invention is also suitable for application to natural products having a different shape, but preferably having a generally convex shape, more preferably having a shape with one end or both ends shaped like a dome.

Still remaining within the confectionery sector, it is possible to refer to hollow or filled chocolate eggs, chocolates or pralines having an approximately spherical shape or with a flat bottom wall.

Figure 7:
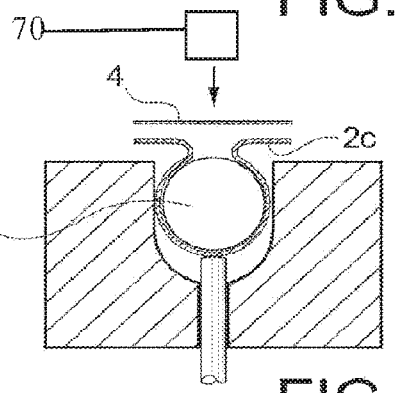

According to the invention, a sealingly adherent wrapper is formed around the product P using two sheets of aluminium or of other laminar material, denoted by 2 and 4 (see FIG. 7 for the latter).

The preferred material constituting the sheets 2 and 4 can be aluminium or polypropylene; however, it is possible to use other plastic material which is suitable for contact with food or else paper or metalized paper; the sheets 2 and 4 can be present in a single layer or in a plurality of layers, for example composite materials or coextrudates such as aluminium/plastic material, paper/plastic material, paper/metalized plastic material. In particular, it is preferable for the two sheets 2 and 4 to be coated on their inner faces, which are intended to face the product P, by a welding lacquer or by a layer of thermowelding material, so as to allow the two sheets to be welded, as will be seen hereinbelow.

The two sheets can be of any desired shape but are preferably cut in advance into a circular shape.

The first step in the operation for packaging the product P consists in an operation for shaping, preferably by deep-drawing, the sheet 2 according to a cup-shaped general configuration (FIGS. 1 and 2). This operation is usually carried out by means of a tool comprising a mould 6 which, in its interior, defines a cavity 6*a*, into which a punch 8 having a shape which is substantially complementary to the cavity 6*a* can penetrate; in particular, the lower part of the cavity 6*a* of the mould has a shape which is exactly complementary to the shape of half of the product P which is intended to be wrapped by the sheet 2.

Figure 4:
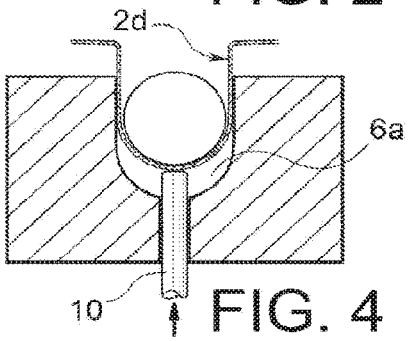

By means of the punch 8, the sheet 2 is thereby shaped according to a cup-shaped configuration comprising a bottom portion 2*a* complementary to said half or bottom portion of the product P, a tubular wall portion 2*b* defining a mouth adapted for the introduction of the product and an annular flange portion 2*c* surrounding the mouth; the tubular wall 2*b* has an axial extension (in height) such that it extends above the top of the product P when the latter is inserted in the shaped sheet; the tubular wall portion, which, as indicated above, extends between the plane of the annular flange 2*c* and the top of the product P, denoted by 2*d* in FIG. 4, will be identified hereinbelow by the term neck portion.

Figure 3:
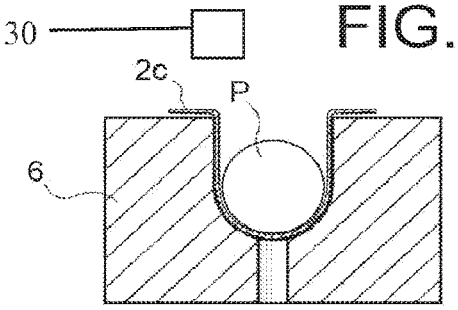

In the next step (FIG. 3), the product P is introduced (e.g., by introducing device 30) in the sheet 2 shaped previously like a cup as indicated; in the illustration in FIG. 3, the product is introduced in the shaped sheet when the latter is housed in the forming cavity 6; it is of course intended that this option is not binding, it being possible to extract the shaped sheet from the mould and transfer it into another mould or into another cavity formation which is able to support the sheet 2 with a view to introducing the product P.

According to a characterising aspect of the process according to the invention, following the introduction of the product P in the cup-shaped sheet 2, a bottleneck operation is carried out on the tubular wall portion 2*b* in its neck portion 2*d*, i.e. in the region immediately above the top of the product. This operation is carried out by binding the annular flange 2*c* or rather limiting its ability to move radially (according to the arrows F2 in FIG. 5); in this way, the tubular wall 2*b* is fitted tightly adhering to the surface of the product, both in its bottom region and in the upper cap region.

FIGS. 4, 5 and 6 show a way of carrying out this operation, this being carried out with the aid of an iris bottleneck tool 12, with the aid of a pressure member 14 and with the aid of extraction means which are connected to vacuum and are associated with the iris tool 12.

According to an optional embodiment, shown in FIG. 4, the shaped sheet, including the product, is lifted by means of a pusher member 10 which can slide in a through-hole through the mould, so as to make the neck portion 2*d* emerge from the forming cavity 6*a*.

The bottleneck operation is performed by means of the iris tool 12, one embodiment of which is shown in FIG. 8. This tool comprises shutter means, denoted as a whole by 16 (FIGS. 9 and 10), which are movable between a configuration in which they define an enlarged opening (FIG. 9) and a configuration in which they define a narrow opening (FIGS. 10 and 8). Said shutter means 16 comprise a plurality of petals 18, 20, 22, 24 (four petals in the example shown), the main faces of which are coplanar and which are associated with an annular plate 26. The plate 26 has a central opening whose profile is denoted by 28 (FIG. 8) and a plurality of eyelets 30, 32, 34 and 36 in which a respective slider 38, 40, 42 and 44 protruding from the surface of the petals which faces the plate 26 engages. The petals are thus capable of linear translation movement relative to the plate 26 in the direction of the arrows F3, F4, F5 and F6 (FIG. 9). The petals have respective front edge profiles 46, 48, 50 and 52 (i.e. the profiles facing the centre of the tool), which, in the enlarged configuration, define a central opening 54 having a dimension such that, when the iris tool is operated, to cause the bottleneck of the shaped sheet, in its neck portion, this opening surrounds the neck portion 2*d*.

The translation movement of the petals is controlled by means of an annular member 56, having a central opening whose profile is denoted by 66 (FIG. 8) and which has a plurality of slits or radial eyelets 58, 60, 62 and 64 in which pins 68 protruding from the upper surface of the petals slidingly engage. The rotation of the annular member 56 (by means of the lever F7) controls the translation movement of the petals from the enlarged configuration to the narrow configuration, shown in FIG. 10, in which the front profiles of the petals define a narrow central opening 70 (FIG. 10 and FIG. 8).

The radial dimension of the opening 70 is such that the sheet 2, following movement of the iris tool into the narrow configuration, has a narrow opening, such that the sheet covers some of the surface of the upper cap of the product P. In one embodiment (FIGS. 4 to 6), for performing the bottleneck operation on the sheet 2 in its neck region 2*d*, the shaped sheet is lifted from the deep-drawing cavity by means of a pusher member 10 so as to make the neck region 2*d* emerge (FIG. 4). Then, the iris tool 12, associated with the mould 6, is moved from its enlarged position (FIG. 5) to its narrow configuration (FIG. 6). At the same time as or before the movement of the iris tool from the enlarged configuration to the narrow configuration, a pressure member 14 is moved in the direction of the arrow F8, so as to bind the annular flange 2*c* between said pressure member and the upper surface of the iris tool. The pressure exerted by the pressure member 14 can be regulated so as to block the edges of flange 2*c* or to limit by friction its ability to slide in the radial direction (arrow F2).

Since the flange is blocked or the ability thereof to slide is limited, the bottleneck operation causes the tubular wall 2*b* of the sheet 2 to be tightly fitted in substantial adhesion with the outer surface of the product.

Optionally or as an alternative, the shutter means 16, in their area of contact with the flange 2*c* of the sheet 2, may have through-holes 12*a* connected to vacuum (FIGS. 5 and 6), which is activated in order to bring about attachment of the shutter means to the flange 2*c*, during the bottleneck operation, further improving the adhesion of the wall of the sheet 2 to the surface of the product and the resultant evacuation of the air, before the sheet 4 is connected to the flange 2*c*.

The axial extension of the neck portion 2*d* is chosen so as to obtain an opening 70*a* (FIG. 6) with a somewhat reduced dimension with respect to the original dimension of the mouth of the cup-shaped sheet.

The operation to lift the shaped sheet, shown in FIG. 4, is to be considered purely optional and illustrative. As indicated in FIGS. 1*a*, 2*a* and 6*a*, it is indeed possible to carry out the deep-drawing of the sheet 2 in a mould 6 with an associated iris tool 12, such that the flange 2*c* is formed above the iris tool (FIG. 2*a*).

The compression operation exerted on the annular flange 2*c* advantageously also flattens the annular surface of the flange, which, following the operation to deep-draw the sheet 2, generally has creases or small pleats, normally with a radial course.

This provides a substantially flat annular flange 2*c*, to which the sheet 4 is connected (FIG. 7) by means of thermowelding or possibly by bonding with the aid of adhesive material.

This provides a packaged product P1, which has the configuration shown in FIG. 11 and is characterised by the presence of a narrow neck region 2*d* surrounded by a flange and formed by the adhesion of the annular flange 2*c* and of the sheet 4. In an optional subsequent operation, said flange can be shaped further, according to the direction of the arrows F9, so as to bring it into contact with the wall portion of the sheet 2 which surrounds the region of the narrow neck.

The process according to the invention can also be adopted for obtaining a product packaged in a sealed wrapper which comprises a small cup, or better a small cup with pleated walls ("fluted case"), following the optional operational steps shown in FIGS. 12 and 13, sequential to the operational step shown in FIG. 6 or 6*a*.

In this embodiment, instead of using a second, flat sheet 4, use is made of a second sheet 4 which has been pre-emptively shaped (for example by deep-drawing) like a small cup, denoted by 5 (FIG. 12), with a base wall 5*a* and a flared and preferably pleated side wall 5*b*.

Analogously to the operation described above with reference to FIG. 6, the small cup or fluted case 5 is positioned, for example by means of a suction tool U, with its base wall 5 a resting on the flange 2 *c* of the first sheet (FIG. 12), with the concavity of the small cup facing in the direction opposite with respect to the flange 2 *c*, or, in the example illustrated, upwards. The base wall 5 *a* and the flange 2 *c* are then connected (e.g., by connecting device 70) by bonding or preferably by thermowelding or ultrasonic welding. If the connection is made by means of thermowelding or ultrasonic welding, the small cup 5, on its outer surface, or at least on the surface of the base wall 5 *a* facing the flange 2 *c*, has a coating formed by a film of thermoweldable material, for example a welding lacquer or a polyethylene composite.

Once the welding operation has been carried out, with the use of a welding plate, the side wall 5*b* is folded by 180° according to the arrows F10 by means of an appropriate tool UI, so as to bring said wall into a position in which it surrounds the wrapped product, at a slight distance therefrom (FIG. 13). Of course, this embodiment involves a final operation to turn the product by 180° such that the base wall 5*b* of the small cup acts as a bearing surface for the packaging.

The process according to the invention therefore achieves the object of obtaining a substantially sealed wrapper which insulates the product from contact with air and which adheres precisely to the outer surface of the product.

It goes without saying that the process according to the invention can be automated and applied in an industrial field providing for the simultaneous packaging of a plurality of products.

Clearly, without departing from the principle of the invention, the embodiments and in particular the constructional details may be greatly varied with respect to that described and illustrated purely by way of non-limiting example, without departing from the scope of the claims which follow.

The invention claimed is:

1. A process for wrapping a product in a wrapper of sheet material, adhering to the surface of the product, comprising the steps of:

providing a first and a second sheet of wrapping material, shaping said first sheet according to a cup-shaped configuration comprising a bottom portion substantially complementary to a bottom portion of the surface of the product, a tubular portion which extends above the top of the product when inserted in said so-shaped sheet and defining a mouth adapted for the introduction of the product and an annular flange terminal portion surrounding said mouth, introducing the product in said first shaped sheet, and connecting said second sheet to said annular flange so as to form a closed wrapper around said product, wherein, following the introduction of the product and prior to connection of said second sheet with said annular flange, the process includes an operation to make a bottleneck of said tubular portion of said first sheet in its region immediately above the top of the product, while exerting on said annular flange a pressure suitable to bind the edges of flange or to limit its radial movement, so as to cause the adhesion of said tubular wall to a substantial portion of the top surface of the product.

2. The process according to claim 1, wherein said bottleneck operation is performed by means of an iris tool comprising shutter means, movable between an enlarged configuration defining an opening whose profile is adapted to surround said tubular portion and a narrow configuration in which said shutter means jointly define an opening whose profile has a small radial dimension.

3. The process according to claim 1, wherein the iris tool comprises a plurality of petals with main coplanar faces capable of straight translation movement and linearly slidably mounted in a respective groove of a support plate and actuator means, associated with said shutter means adapted to cause the translation of said petals simultaneously from the enlarged configuration to the narrow configuration.

4. The process according to claim 1, wherein the bottleneck operation is performed while exerting a compression of said annular flange between a pressure member and the surface of said iris tool facing said pressure member.

5. The process according to claim 1, wherein following the connection of the second sheet to said annular flange said flange is folded into contact with the wall of the wrapper.

6. The process according to claim 1, wherein said second sheet is a sheet pre-emptively shaped as a small cup, comprising a base wall and a flared, pleated, side wall.

7. The process according to claim 6, wherein said second sheet, shaped as a small cup, has a heat melting coating on its outer surface.

8. The process according to claim 6, wherein said second sheet shaped as a small cup is positioned with said base wall resting on the annular flange and with the concavity facing in the direction opposite with respect to said flange, the base wall of said small cup is connected by welding or bonding to said flange, and then said side wall is overturned into a position surrounding the product wrapped by said first sheet.

9. The process according to claim 1, wherein said first and second sheet are sheets of aluminium, paper or plastic material coated on the side facing toward the product with a heat melting lacquer.

10. The process according to claim 1, wherein said first and second sheet are selected from aluminium/plastic material and paper/plastic material composites coated with a heat melting lacquer.

11. A packaging apparatus to wrap a product in a wrapper of sheet material, adhering to the surface of the product formed from a first and a second sheet of wrapping material, comprising:

forming means for shaping said first sheet in a cup-shaped configuration comprising a bottom portion substantially complementary to a bottom portion of the surface of the product, a tubular portion which extends above the top of the product when it is inserted in said so-shaped sheet and defining a mouth adapted for the introduction of the product and an annular flange terminal portion surrounding said mouth;

an introducing device for introducing the product in said first shaped sheet; and means for connecting said second sheet to said annular flange, wherein the packaging apparatus includes an iris tool configured to make a bottleneck of said tubular portion of said first sheet in its region immediately above the top of the product and a pressure member cooperating with said iris tool to exert on said annular flange a pressure suitable to bind the edges of the flange or to limit its radial movement in the course of the bottleneck operation, so as to cause the adhesion of said tubular wall to a substantial portion of the top surface of the product, wherein said pressure member is arranged to cooperate with said iris tool to constrain or limit the sliding of the edges of said annular flange during the operation of said iris tool making the bottleneck of said tubular portion of said first sheet.

12. The apparatus according to claim 11, wherein said iris tool comprises shutter means movable between an enlarged configuration defining an opening, whose profile is adapted to surround said tubular portion and a narrow configuration in which said shutter means jointly define an opening whose profile has a small radial dimension.

13. The apparatus according to claim 12, wherein said shutter means comprise a plurality of petals with main coplanar faces capable of straight translation movement and linearly slidably mounted in a respective groove of a support plate and actuator means associated with said shutter means adapted to cause the translation of said petals simultaneously from the enlarged configuration to the narrow configuration.

14. A packaging apparatus to wrap a product in a wrapper of sheet material, adhering to the surface of the product formed from a first and a second sheet of wrapping material, comprising:

a mould having a cavity for shaping said first sheet in a cup-shaped configuration by use of a punch having a shape complementary to said cavity, said first sheet in a cup-shaped configuration comprising a bottom portion substantially complementary to a bottom portion of the surface of the product, a tubular portion which extends above the top of the product when it is inserted in said so-shaped sheet and defining a mouth adapted for the introduction of the product and an annular flange terminal portion surrounding said mouth;

an introducing device for introducing the product in said first shaped sheet;

a connecting device for connecting said second sheet to said annular flange;

an iris tool configured to make a bottleneck of said tubular portion of said first sheet in a region immediately above the top of the product; and a pressure member configured to cooperate with said iris tool to exert on said annular flange a pressure suitable to bind the edges of the flange or to limit its radial movement in the course of a bottleneck operation, so as to cause the adhesion of said tubular wall to a substantial portion of the top surface of the product, wherein said pressure member is arranged to cooperate with said iris tool to constrain or limit the sliding of the edges of said annular flange during the operation of said iris tool making the bottleneck of said tubular portion of said first sheet.

* * * * *